US007132010B2

(12) United States Patent
Carlsson

(10) Patent No.: US 7,132,010 B2
(45) Date of Patent: Nov. 7, 2006

(54) AIR FILTERING SYSTEM

(75) Inventor: Thomas Carlsson, Borås (SE)

(73) Assignees: Scandfilter AB, Svenljunga (SE); Elfi Elektrofilter AB, Alingsas (SE)

( * ) Notice: Subject to any disclaimer, the term of this patent is extended or adjusted under 35 U.S.C. 154(b) by 0 days.

(21) Appl. No.: 10/952,907

(22) Filed: Sep. 30, 2004

(65) Prior Publication Data

US 2005/0081719 A1 Apr. 21, 2005

(30) Foreign Application Priority Data

Oct. 21, 2003 (SE) ..... 0302777-8

(51) Int. Cl.
*B03C 3/155* (2006.01)

(52) U.S. Cl. ..... 96/55; 96/59; 96/66; 96/77

(58) Field of Classification Search ..... 96/55, 96/59, 66, 75–79

See application file for complete search history.

(56) References Cited

U.S. PATENT DOCUMENTS

| | | | | |
|---|---|---|---|---|
| 4,072,477 | A * | 2/1978 | Hanson et al. | 95/71 |
| 4,798,850 | A * | 1/1989 | Brown | 521/134 |
| 5,009,683 | A * | 4/1991 | Sun | 96/66 |
| 5,013,502 | A * | 5/1991 | Reinehr et al. | 264/103 |
| 5,419,953 | A * | 5/1995 | Chapman | 442/35 |
| 5,470,485 | A * | 11/1995 | Morweiser et al. | 210/748 |
| 5,573,577 | A * | 11/1996 | Joannou | 96/66 |
| 5,855,653 | A * | 1/1999 | Yamamoto | 96/58 |
| 5,898,981 | A * | 5/1999 | Legare | 28/111 |
| 6,231,646 | B1 * | 5/2001 | Schweizer et al. | 96/17 |
| 6,328,788 | B1 * | 12/2001 | Auger | 96/17 |
| 6,364,935 | B1 * | 4/2002 | Wennerstrom | 95/57 |
| 6,547,860 | B1 * | 4/2003 | Buchwald et al. | 96/17 |
| 6,623,548 | B1 * | 9/2003 | Gordon et al. | 96/15 |
| 6,790,259 | B1 * | 9/2004 | Rittri et al. | 95/78 |
| 2004/0139854 | A1 * | 7/2004 | Rittri et al. | 95/70 |
| 2005/0045036 | A1 * | 3/2005 | Vetter et al. | 96/66 |

FOREIGN PATENT DOCUMENTS

| | | | | |
|---|---|---|---|---|
| JP | 55-109426 | * | 8/1980 | 96/66 |

* cited by examiner

*Primary Examiner*—Richard L. Chiesa
(74) *Attorney, Agent, or Firm*—Harness, Dickey & Pierce

(57) ABSTRACT

An air filtration system including a filter (4) for separation of particles and an ionizer (3) for ionization of the air. In use of the system, ionization of the air occurs before the air passes the filter (4). The filter (4) is made up of fibers of polypropylene mixed with acrylic.

4 Claims, 2 Drawing Sheets

AIR FILTERING SYSTEM

FIELD OF THE INVENTION

The present invention relates to a system in filtration of air, comprising a filter for separation of particles and a means for ionization of the air, ionization of the air, in use of the system, occurring before the air passes said filter.

BACKGROUND ART

Systems as described above are today of frequent occurrence. Ionization means that the degree of separation is increased, or alternatively that penetration decreases. In filters, it is desirable to have as little penetration of particles as possible and at the same time have as small a pressure drop as possible. A filter system with a relatively coarse filter which usually has a penetration of about 35% can be improved by ionization of the air before the air passes through the filter. The penetration can for the same filter as described above be reduced to about 10% by ionization of the air before the air passes through the filter. Thus, such a system has the advantage that the pressure drop is low as a consequence of a coarse filter being used while at the same time penetration decreases. In some cases, however, it is necessary for the penetration of particles to be still lower. This is achieved in prior-art technique by using filters with finer fibers, i.e. tighter filters, which however also bring about the effect that the pressure drop increases. Getting penetration down from 10% means as a rule that the pressure drop increases since a "tighter" filter has to be used.

SUMMARY OF THE INVENTION

The object of the present invention therefore is to provide a system in filtration of air, which system reduces the penetration of particles still more compared with prior-art technique, while at the same time the pressure drop is maintained.

The inventive system in filtration of air comprises a filter for separation of particles and a means for ionization of the air, ionization of the air, in use of the system, occurring before the air passes said filter. Moreover, the filter is made up of fibers of polypropylene mixed with acrylic.

Thus, the invention is based on the fact that it has been found that precisely the combination of ionizing the air and, after that, filtering the air using a filter made up of fibers of polypropylene mixed with acrylic results in a penetration of particles that is as low as 1to 2%. This should be compared with the previously mentioned penetration of about 10%. The main advantage thus is that the pressure drop is the same in spite of an essentially decreased penetration.

A particularly low penetration of particles is obtained if modified acrylic is used. In this case modified acrylic means that polyvinyl chloride is grafted into the acrylic.

In one embodiment, the system is arranged in an air cleaner. The air cleaner can in some cases be a solution when it is desirable to reduce the particle content of indoor air, especially in rooms without mechanical supply of air. Under certain conditions, however, large amounts of particles are generated in a room owing to the activities performed, and then it is suitable to have also a separate air cleaner in addition to cleaning of the supply air.

In an alternative embodiment, the system is arranged in an air supply system. The advantage of this is that the supplied air is filtered and, thus, no extra space-requiring "can" is necessary in the room in order to clean the air. However, particles generated in the room will consequently not be filtered off.

In another alternative embodiment of the present invention, a means is arranged downstream of the filter in the system for bipolar ionization of the air. Due to this ionization, small particles in the air react with each other and precipitate on the floor. The energy level of the oxygen in the air is increased and accelerates the breaking-down of organic substances in the air. In this way odors and harmful substances are effectively broken down.

BRIEF DESCRIPTION OF FIGURES

The invention will below be described in more detail by means of embodiments with reference to the accompanying schematic figures which by way of example illustrate currently preferred embodiments of the invention.

DESCRIPTION OF PREFERRED EMBODIMENTS

Figure 1:
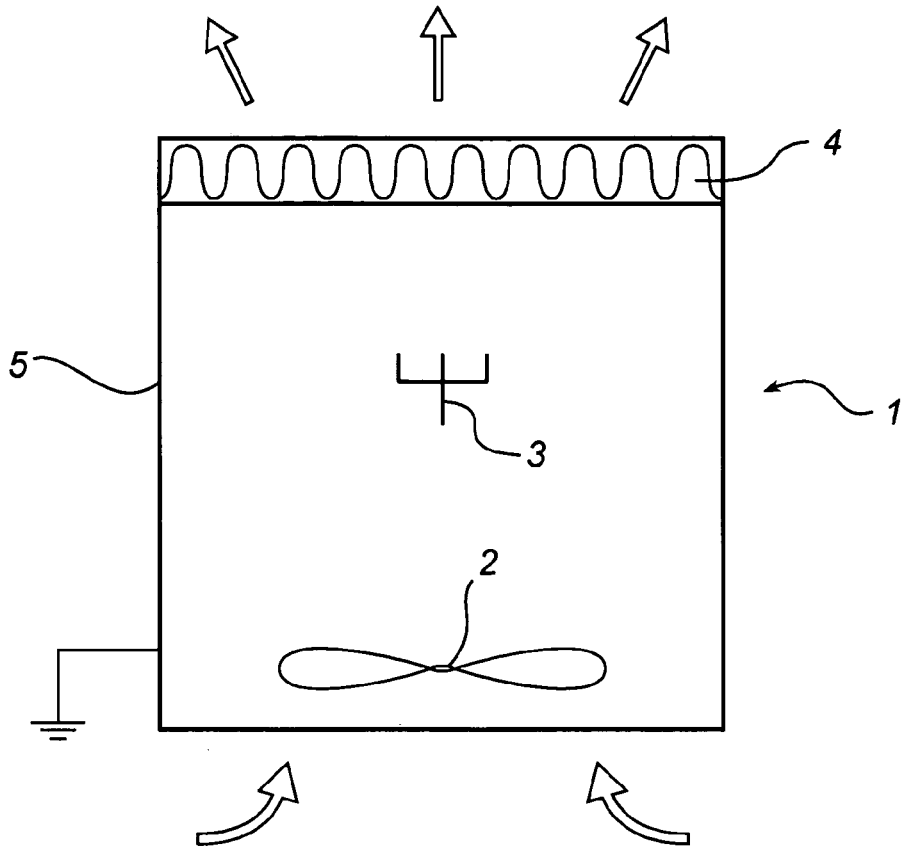
FIG. 1 is a schematic view of a system according to the present invention arranged in an air cleaner.

FIG. 1 shows an air cleaner 1 comprising a fan 2, an ionizing means 3, a filter 4 and an earthed casing 5. The air is delivered to the air cleaner 1 by means of the fan 2, after which the air flows past the ionizing means 3, whereby the air is ionized. After the air has been ionized, it thus flows through the filter 4. The filter 4 is preferably made of polypropylene mixed with modified acrylic, i.e. in this case polyvinyl chloride is grafted into the acrylic. The polypropylene fibers and the acrylic are processed in a carding process to produce filter material comprising portions which are negatively charged and other portions which are positively charged, an electric field arising in the filter material that helps to catch the particles in the ionized air. The effect of the ionization differs, depending on the properties of the particles, such as material, size and temperature. In some cases, the particles form lumps, which makes it easier for them to be absorbed by the filter 4. In other cases, it is the increased attraction of the particles that makes them more easily affected by the electric field in the filter 4. In some cases, a combination of these two effects may of course be used.

Figure 2:
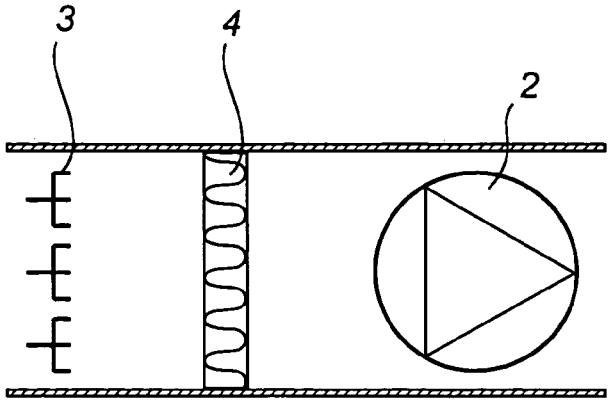
FIG. 2 is a schematic view of a system according to the present invention arranged in an air supply system.

In FIG. 2, an ionizing means 3 and a filter 4 are arranged in an air supply duct where the air is filtered before it reaches the fan 2, which is the normal procedure in air supply devices. The principle of filtering is the same as for the air cleaner in FIG. 1, except that it is only the supply air that is being filtered. Particles generated in the ventilated space are thus not filtered.

Figure 3:
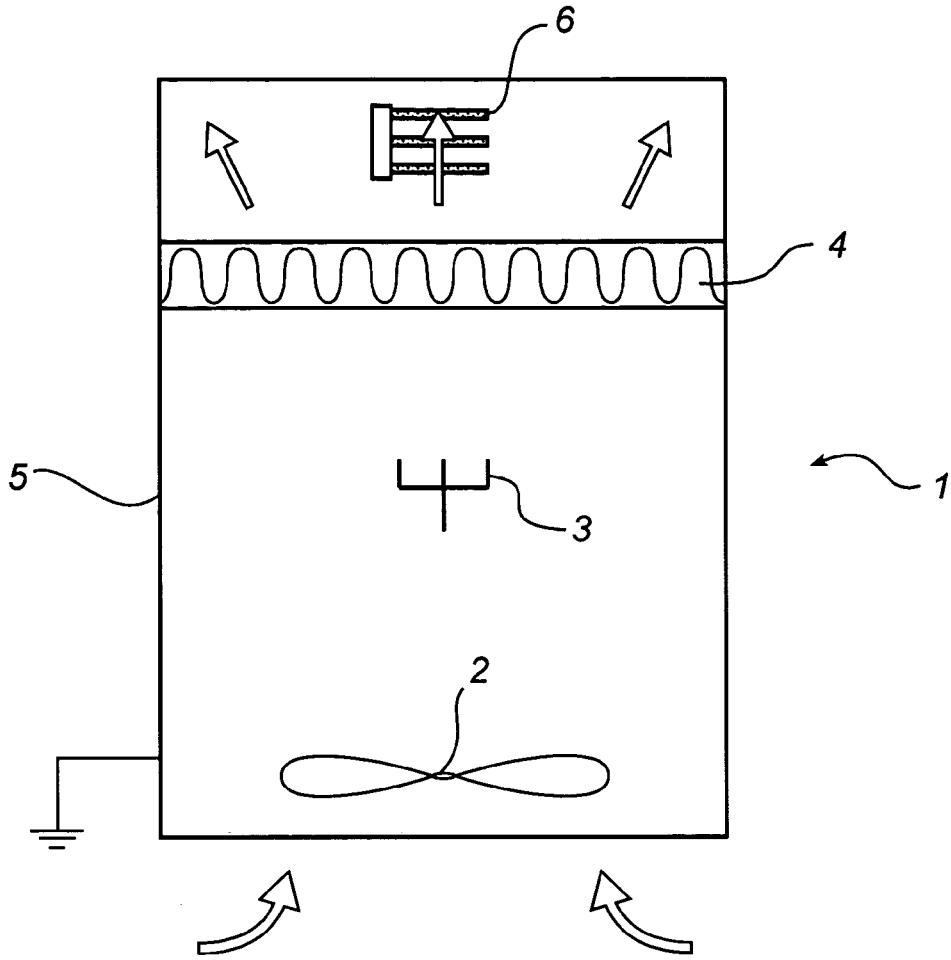
FIG. 3 illustrates a system according to FIG. 1 with a means for bipolar ionization.
Figure 4:
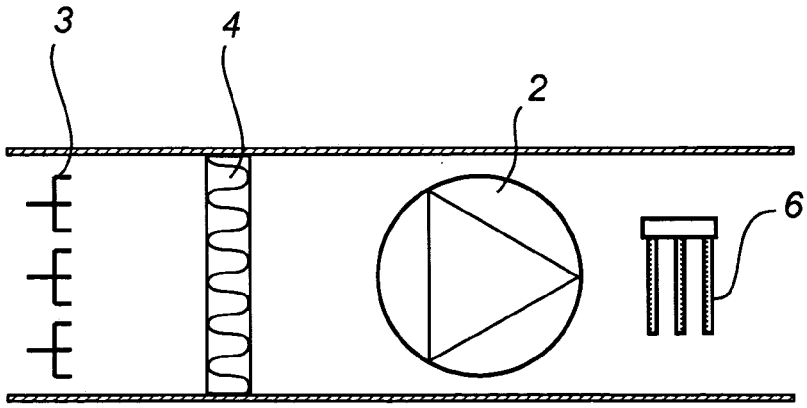
FIG. 4 illustrates a system according to FIG. 2 with a means for bipolar ionization.

In order to further improve the quality of air, it is possible to arrange an ionizing means 6 after the filter 4 so as to ionize the air and the particles passing through the filter 4 in a bipolar manner. The particles will then form lumps and precipitate on the floor. Also the energy level of the oxygen in the air is increased, which accelerates the breaking-down of organic substances in the air. FIGS. 3 and 4 illustrate a corresponding air cleaner 1 from FIG. 1 and a system according to the present invention in an air supply duct from FIG. 2, where a means 6 is arranged for bipolar ionization of the air after passing through the filter 4.

It will be appreciated that many modifications of the embodiments described above are conceivable within the scope of the invention, as defined by the appended claims.

The invention claimed is:

1. An air filtration system comprising:

an earthed casing, a fan positioned within said casing, an ionizer positioned within said casing;

a filter including fibers of polypropylene mixed with acrylic positioned within said casing downstream of said ionizer, and a bipolar ionizer positioned within said casing downstream of said filter.

2. A system as claimed in claim 1, in which polyvinyl chloride is grafted into the acrylic.

3. A system as claimed in claim 1, which system is arranged in an air cleaner.

4. A system as claimed in claim 1, which system is arranged in an air supply system.

* * * * *